US007059924B2

(12) United States Patent
Farmer et al.

(10) Patent No.: US 7,059,924 B2
(45) Date of Patent: Jun. 13, 2006

(54) PERSONAL FLOTATION DEVICE

(75) Inventors: Michael W. Farmer, Troy, NY (US); Cecilia M. Domingos, Ballston Lake, NY (US); Michael J. Lobsinger, Cohoes, NY (US); Jeffrey R. Betz, Cohoes, NY (US)

(73) Assignee: Float Tech Inc., Troy, NY (US)

( * ) Notice: Subject to any disclaimer, the term of this patent is extended or adjusted under 35 U.S.C. 154(b) by 0 days.

(21) Appl. No.: 10/413,924

(22) Filed: Apr. 15, 2003

(65) Prior Publication Data

US 2004/0082237 A1 Apr. 29, 2004

Related U.S. Application Data

(60) Provisional application No. 60/421,455, filed on Oct. 26, 2002.

(51) Int. Cl.
*B63C 9/125* (2006.01)

(52) U.S. Cl. ..... 441/106; 441/107; 441/117; 441/118

(58) Field of Classification Search ..... 441/106–119
See application file for complete search history.

(56) References Cited

U.S. PATENT DOCUMENTS

| | | | | |
|---|---|---|---|---|
| 2,346,019 | A * | 4/1944 | Valentine | 441/108 |
| 2,521,205 | A * | 9/1950 | David | 441/102 |
| 2,607,934 | A | 8/1952 | Bailhe | |
| 3,199,128 | A | 8/1965 | Nöjd | |
| 3,266,069 | A * | 8/1966 | O'Link | 441/107 |
| 3,266,070 | A | 8/1966 | O'Link | |
| 3,345,657 | A * | 10/1967 | Peeler et al. | 441/92 |
| 3,354,480 | A | 11/1967 | Harding et al. | |
| 3,441,963 | A | 5/1969 | Steinthal | |
| 3,931,657 | A | 1/1976 | Jones | |
| 4,097,947 | A | 7/1978 | Kiefer | |
| 4,263,686 | A * | 4/1981 | Jarvis, Jr. | 441/116 |
| 4,767,371 | A | 8/1988 | Jackson | |
| 4,864,656 | A | 9/1989 | Nesse | |
| 6,546,561 | B1 * | 4/2003 | Duhamell | 2/102 |

FOREIGN PATENT DOCUMENTS

| | | |
|---|---|---|
| CA | 1085235 | 9/1980 |
| EP | 0023430 | 2/1981 |
| NL | 297545 | 9/1962 |

OTHER PUBLICATIONS

Chagnon's Outdoor World, 5 pages printed from www.outdoor-catalog.com on Feb. 21, 2003.
Fogdog Sports, 2 pages printed from www.fogdog.com on Feb. 21, 2003.
Stormy Seas, 14 pages printed from www.stormyseas.com on Feb. 21, 2003.
International Search Report for PCT/US 03/33369, dated Mar. 11, 2004 (7pgs.).

* cited by examiner

*Primary Examiner*—Sherman Basinger
(74) *Attorney, Agent, or Firm*—Wolf Greenfield & Sacks P.C.

(57) ABSTRACT

A personal flotation device that may be worn alone, as well as fitted into a separate garment, such as a jacket or vest. The personal flotation device may include a wearable inflatable bladder that is selectively adjustable into a retaining configuration that fits to a wearer and into a loosened configuration that is removable from the wearer. A closure system maintains the bladder in the retaining configuration. A first component of a releasable attachment system may be provided with the wearable inflatable bladder, whereby the first component is attachable to a complementary second component of the releasable attachment system that is provided on a separate garment to integrate the inflatable bladder and the separate garment.

60 Claims, 5 Drawing Sheets

PERSONAL FLOTATION DEVICE

RELATED APPLICATIONS

This application claims priority under 35 U.S.C. § 119(e) to U.S. Provisional Application Ser. No. 60/421,455 entitled "Method to Fasten Inflation Flotation Technology into a Jacket or Vest," filed on Oct. 26, 2002, which is herein incorporated by reference in its entirety.

FIELD OF INVENTION

This invention generally relates to personal flotation devices, and in particular to personal flotation devices that may be worn alone, as well as fitted into a separate garment, such as a jacket or vest.

BACKGROUND OF INVENTION

Certain laws in the United States, and in other countries, require boaters and other waterway users to wear, or have readily accessible, safety equipment that will help prevent drowning, such as life vests, life preservers, and other Personal Flotation Devices (PFDs).

There are five categories of U.S. Coast Guard approved Personal Flotation Devices. Type I is limited to Offshore Lifejackets designed for extended survival in rough open water. Type II is designated as a Near Shore Buoyant Vest meant for calm inland water where there would probably be a fast rescue. Many Type II PFDs are arranged to turn an unconscious person face up in the water to help prevent drowning. A Type III device applies to life jackets to be worn during water sports (i.e. water-skiing, jet-skiing) and are geared for use in calm water where there is a good chance for a fast rescue. A Type III device is generally not designed to turn an unconscious person face up in the water. Type IV flotation devices are throwable devices including boat cushions and ring buoys, and Type V devices are restricted to special uses, such as work vests, deck suits and hybrid vests.

PFDs typically include either an inherently buoyant material, an inflatable chamber, or a combination of an inherently buoyant material and an inflatable chamber (hybrid PFD) to provide the buoyancy for a person to stay afloat. An inherently buoyant PFD may be formed of a foam or other low density material and usually is bulky and uncomfortable to wear. Consequently, many boaters and other water enthusiasts resist wearing an inherently buoyant PFD.

Inflatable PFDs have a much smaller profile than inherently buoyant PFDs and are much less cumbersome to wear. However, many waterway users still fail to wear an inflatable PFD because they are not fashionable when worn over the user's regular clothing. It has been known to position an inflatable bladder within the interior of the garment. Such arrangements, however, do not provide the versatility of the present inventive PFD which may be worn alone or, instead, integrated with a separate garment.

SUMMARY OF INVENTION

In one embodiment of the invention, a personal flotation device is provided including a wearable inflatable bladder that is selectively adjustable into a retaining configuration that fits to a wearer and into a loosened configuration that is removable from the wearer. The inflatable bladder is arranged to keep a person buoyant in water when the bladder is inflated. A closure system is provided for releasably securing the inflatable bladder to the wearer at a desired tightness. A first component of a releasable attachment system is provided with the wearable inflatable bladder, whereby the first component is attachable to a complementary second component of the releasable attachment system that is provided on a separate garment to integrate the inflatable bladder and the separate garment. At least a portion of the first component of the attachment system being independent of the closure system. The bladder, when inflated, keeps a person wearing the garment integrated with the bladder, buoyant in water. The closure system and/or the attachment system may be connected to the bladder, or to a shell or lining that receives or covers the bladder.

In another embodiment of the invention, a personal flotation device is provided including a wearable inflatable bladder having first and second portions, a collar, a front side and a back side, the relative positioning of the first and second portions being selectively adjustable to vary a tightness of a fit of the wearable inflatable bladder. The inflatable bladder is arranged to keep a person buoyant in water when the bladder is inflated. A closure system is provided for releasably securing the first and second portions at a desired tightness of fit of the inflatable bladder to the wearer. A harness extends around the back side of the inflatable bladder. A first component of a releasable attachment system that is attachable to a complementary component of the attachment system being provided on a separate garment is provided to integrate the inflatable bladder and the separate garment, so that the bladder, when inflated, keeps a person wearing the garment that has been integrated with the bladder, buoyant in water. The first component of an attachment system is included on the harness.

In another embodiment of the invention, a personal flotation device is provided including a wearable inflatable bladder having first and second chest portions, a collar, and an inner edge that extends along the first and second chest portions and the collar. The relative positioning of the first and second chest portions is selectively adjustable to vary a tightness of a fit of the wearable inflatable bladder. The inflatable bladder is arranged to keep a person buoyant in water when the bladder is inflated. A closure system is provided for releasably securing the first and second chest portions at a desired tightness of fit. A first component of a releasable attachment system is provided on the wearable inflatable bladder, whereby the first component is attachable to a complementary component of the attachment system being provided on a separate garment to integrate the inflatable bladder and the separate garment, so that the bladder, when inflated, keeps a person wearing the garment that has been integrated with the bladder, buoyant in water. The first component of the attachment system is arranged adjacent at least a portion of the inner edge at least partially around the collar. The closure system and/or the attachment system may be connected to the bladder, or to a shell or lining that receives or covers the bladder.

In another embodiment of the invention, a personal flotation device is provided including an inflatable bladder having first and second chest portions and a collar, and an inner edge that extends along the first and second chest portions and the collar. A snap fit releasable closure system is provided including a first piece extending from the first chest portion and a complementary second piece extending from the second chest portion. The snap fit closure system being adjustable to vary the tightness of fit of the first and second chest portions to a wearer. A zipper extends adjacent the inner edge at least partially along the collar. The closure system and/or the zipper may be connected to the bladder, or to a shell or lining that receives or covers the bladder.

In another embodiment of the invention, a personal flotation device is provided including a fabric shell with an inflatable bladder, the fabric shell having a first section and a second section. A relative positioning of the first section and the second section being selectively adjustable into a retaining configuration where the fabric shell is fitted to the wearer and into a loosened configuration where the fabric shell is removable from the wearer. A first closure system is provided for releasably securing the first and second sections in the retaining configuration so that the bladder, when inflated, keeps a person buoyant in water when wearing the fabric shell alone. A component of a second closure system is arranged with the fabric shell and is releasably engaged with a complementary component of the second closure system that is located on a separate garment, integrating the fabric shell with the separate garment so that the bladder, when inflated, keeps a person wearing the garment integrated with the fabric shell and in the retaining configuration, buoyant in water.

In another embodiment of the invention, a personal flotation device is provided including a wearable inflatable bladder and means for releasably fitting the inflatable bladder to a person so that the person becomes buoyant in water when the bladder, worn alone, is inflated. Also provided are means for releasably attaching the inflatable bladder to a separate garment so that the inflatable bladder is integrated with the separate garment, wherein a person wearing the separate garment integrated with the inflatable bladder is buoyant in water when the bladder is inflated. The means for releasably fitting and/or the means for releasably attaching may be connected to the bladder, or to a shell or lining that receives or covers the bladder.

Another embodiment of the invention is a method of assembling a personal flotation device. A wearable inflatable bladder having a first section, a second section, and a collar, is provided, the first and second sections being selectively adjustable to vary a tightness of the inflatable bladder about a wearer. A separate garment having a collar and first and second portions also is provided. The wearable inflatable bladder is attached to an interior of the separate garment so that the garment is integrated with the inflatable bladder, whereby a person wearing the garment integrated with the bladder will be buoyant in water when the bladder is inflated.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Various embodiments of the present invention provide a versatile PFD that may be worn either alone or fitted into a separate garment, transforming the separate garment into a PFD. If it is desired to wear the garment without the PFD, the PFD may be removed. Although the PFD is described in combination with a jacket or vest, the invention is not so limited and the PFD may be releasably fitted to other types of garments. When integrated with the separate garment, the PFD may lie relatively flat against the interior of the garment so that the garment including the PFD is comfortable to wear and the inclusion of the PFD does not notably detract from the fashion appearance of the garment.

Figure 1:
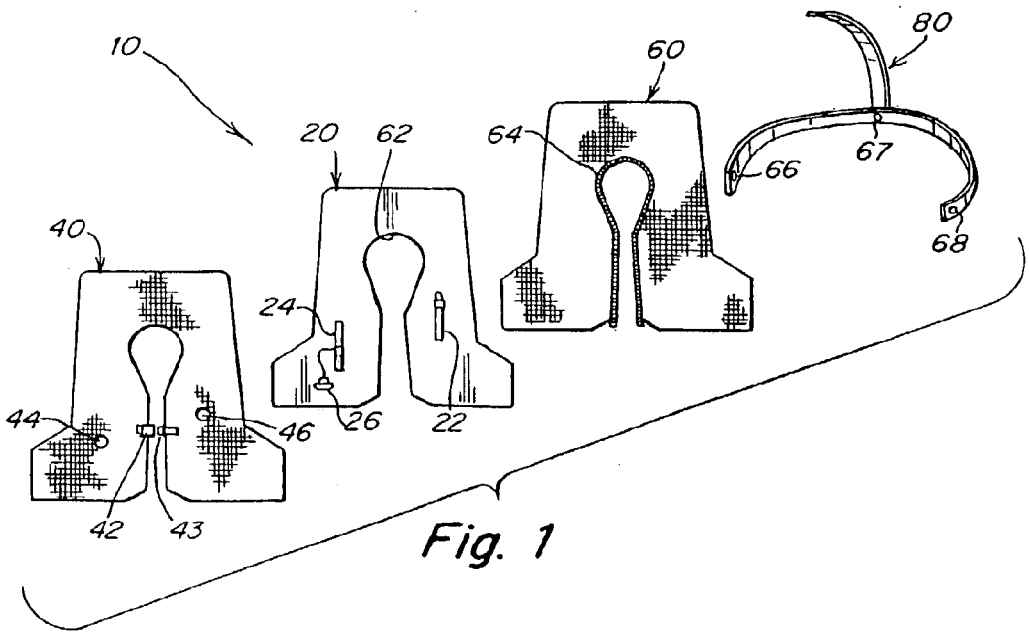
FIG. 1 illustrates an exploded view of the personal flotation device.
Figure 2:
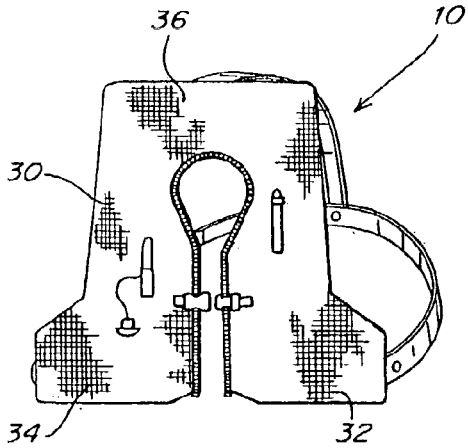
FIG. 2 illustrates an assembly view of the personal flotation device.

One embodiment of a PFD 10 according to the present invention is illustrated in FIGS. 1–2 and includes an inflatable bladder 20 having a collar 36, a first portion and a second portion, such as the chest portions 32, 34 shown, and a closure system for securing the relative positioning of the first and second portions at a desired tightness about a wearer. Although the separated portions are shown as chest portions the invention is not so limited and the first and second portions could include side portions, such as near the kidneys, back portions, and other arrangements as should be apparent to one of skill in the art. A shell or lining 30 may be provided to receive or cover the bladder. When referencing a shell, it is meant that the PFD is worn alone, while when referenced as a lining, the PFD has been integrated into the separate garment. Although the illustrated shell or lining encloses but is not fixed to the bladder, in other embodiments one or more fabric layers may be united directly to the inflatable bladder 20. The closure system and the attachment system, to be discussed below, may be connected directly to the inflatable bladder, or to the mesh or lining 30.

The closure system may include a pair of releasably engageable buckles 42, 43, as shown, that extend, respectively, from each of the chest portions of the bladder, or shell or lining. The buckles may be tethered by a strap to allow adjustment of the positioning of the buckles, so that when the buckles are engaged the closure system may be tightened or loosened by adjusting the length of the straps. Although side release type buckles are shown, the invention contemplates other refastenable closures system as would be apparent to one of skill in the art including, but not limited to, hook and loop strips, cam buckles, ratchet buckles, rings, clips, snap hooks, zippers, snap fasteners, dual and multiple loop buckles, and other types of buckles. Also, the closure system may be provided by the configuration of the bladder itself. For example, the material making up or incorporated into the bladder may be resilient allowing the first and second portions to be separated into a looser configuration that facilitates placement of the bladder on the wearer with the resilient portions then naturally returning to their original constrictive arrangement once the bladder is in place on the wearer.

A secondary support system 80 also may be provided to further secure the inflatable bladder 20 to a wearer. The support system is not limited to a particular form or structure and may for example, include a harness such as a waist strap, as illustrated, that surrounds the back of the wearer and may further include a stability strap that runs from the waist strap to an upper end of the PFD. The harness may be adjustable allowing a wearer to selectively tighten the harness and to selectively loosen the harness as may be desired. A PFD with an adjustable closure system and/or harness may be worn by varyingly sized and shaped users as well as allow individual users to regulate the fit and comfort of the PFD.

To integrate a PFD into a separate garment, such as a jacket or vest, at least one component of a releasable fastener system is provided on the PFD that is attachable with a complementary component of the fastener system provided on the separate garment. In the embodiment shown in FIGS. 3–4, the releasable fastener system includes a zipper 64 located along an inner edge 62 of the inflatable bladder, or shell or lining 30, and which extends along the chest portions 32, 34 and around the collar 36. A complementary zipper 264 is provided along the interior of the separate garment, so that engagement of the respective zipper components joins the inner edges of the chest portions of the PFD to the inner edges of the chest portions of the interior of the separate garment. Similarly, if the zipper segments are provided along the collar of the PFD and of the separate garment, then the engagement of the zipper components will secure the collar of the PFD to the collar at the interior of the separate garment. A zipper pull that interconnects the separate zipper tracks may be provided on the separate garment, on the PFD, or on both. For safety reasons, it may be preferred to provide the zipper pull on the separate garment so that the PFD when worn alone may not be closed with the zipper but, instead, will require engagement of the more robust side release buckles 42, 43 or other closure system component.

As illustrated, the releasable attachment system for joining the PFD to the interior of a separate garment may further include one or more snap fasteners 66, 67, 68 that are provided on the support system 80 and which are attachable to complementary snap fastening components 266, 267, 268 that are provided in the separate garment 200. The snap fasteners may be provided along a lower portion of the PFD and the separate garment, as shown, or may be placed elsewhere on each piece as should be apparent to one of skill in the art. In addition to, or in lieu of the fasteners provided on the support system, releasable fastener components also could be provided along other aspects of the PFD. For example, and without limitation, a side release buckle, or another fastener such as one of the many fasteners identified above, could be provided at an outer edge of the chest portions.

It should be appreciated by one of skill in the art that the attachment system is not limited to a particular type of fastener or combination of fasteners. Without limiting the foregoing, in addition to the zipper and snap fasteners already mentioned, other components that are contemplated include clips, hooks and loops, buttons, and buckles. It also is observed that the releasable fastener components do not have to extend continuously about the PFD and/or the separate garment, and arrangements using only a single fastener or two or more spaced fasteners are also contemplated. A component of the releasable attachment system for joining the PFD and the separate garment may also include a feature otherwise provided on the PFD. In certain embodiments, for example, it is contemplated that the buckles of the closure system for adjusting the first and second portions of the PFD into a retaining configuration may be attachable to complementary buckles arranged on the interior of the garment so as to cooperate in the attaching of the PFD to the separate garment. It is envisioned, however, for those embodiments where the closure system is part of the attachment system that the attachment system will include components in addition to the closure system; that is, the attachment system at least in part will be independent of the closure system. In another embodiment of the attachment system that employs an existing PFD element, one or more straps of the support system 80 on the PFD is held by one or more loops on the interior of the separate garment, helping to secure the PFD to the garment.

Figure 3:
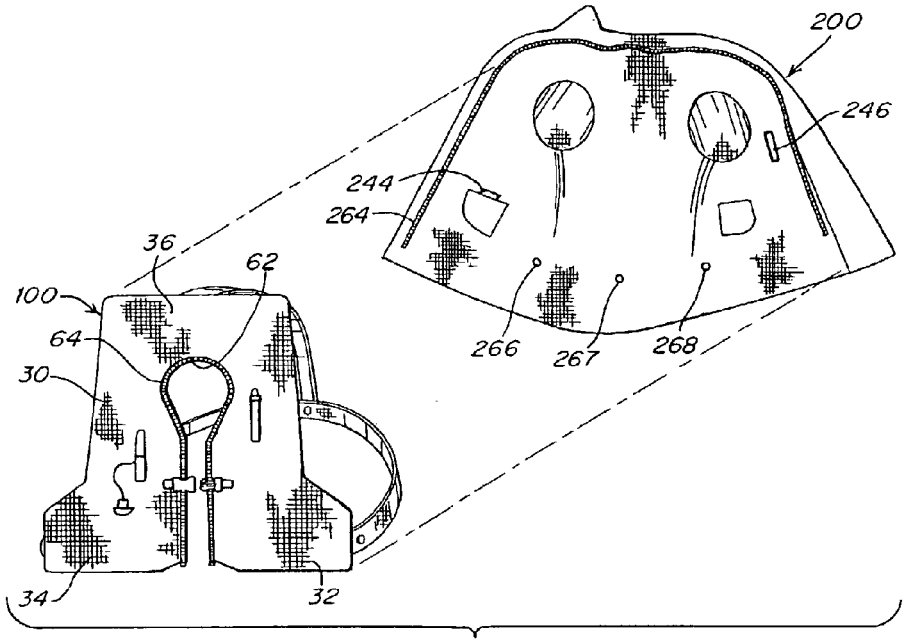
FIG. 3 illustrates the personal flotation device liner and the corresponding mating connections on a garment.
Figure 4:
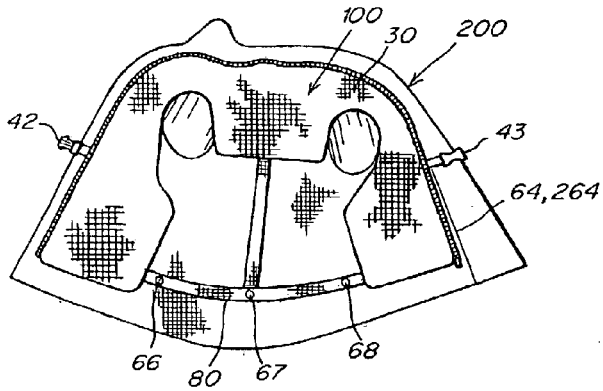
FIG. 4 illustrates the interior view of the garment.

In the embodiment shown in FIG. 3, each of the PFD and the separate garment include a first chest portion 32, a second chest portion 34 and a collar 36. An inner zipper 264 component of the attachment system is located inward of an outer zipper (not shown) or other fastening arrangement for closing and sealing the first and second chest portions of the garment. The inner zipper 264 is engageable with the zipper segment 64 running along the chest and collar portions of the PFD. The buckles 42, 43 of the closure system on the PFD are located near the zipper component of the attachment system on the PFD so that when the zipper of the PFD liner 100 is fastened to the zipper on the separate garment 200, integrating the two pieces together, the buckles 42, 43 of the closure system will be located at the chest area of the garment where they can be secured together to tighten the PFD about the wearer when the separate garment integrated with the PFD is worn.

As observed earlier, the inflatable bladder may include a shell or lining 30 that may be comprised of a front panel 40 and a back panel 60. The size and shape of the shell or lining may approximate the shape and size of the inflatable bladder 20. This may help to ensure uniform inflation of the PFD 10. However, the relative shapes of the two components is not a critical feature of the invention and varying sizes and shapes may be employed as should be apparent to one of skill in the art. In the drawings, each of the shell or lining and the inflatable bladder have a generally U-shaped configuration that may be further characterized by a first chest portion 32, a second chest portion 34 and a collar 36. The collar may be arranged to turn a wearer's head out of the water. While the illustrated inflatable bladders include only a single, unitary chamber having fluid communication throughout the interior of the bladder, it is appreciated that an inflatable bladder according to this invention may include two or more separate inflatable chambers. For example, an inflatable bladder could be configured with a first chest portion chamber, a second chest portion chamber and a collar chamber. The shell or lining 30 may contain an opening to provide access to the bladder 20 so that the bladder may be inspected, repositioned, cleaned, removed and replaced, and the like. A refastenable component may be configured to seal the access opening such as a zipper, snap fasteners, clips, hook and loops, etc.

Figure 9:
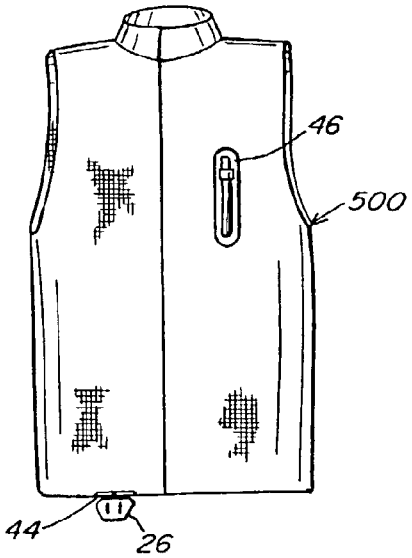
FIG. 9 illustrates an embodiment where the inflation means is positioned along the bottom side of the vest.
Figure 10:
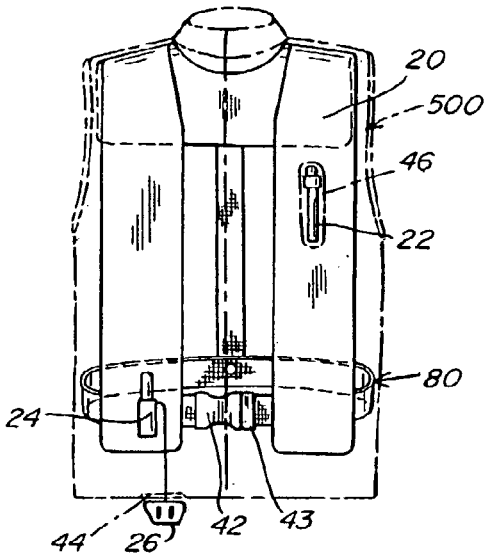
FIG. 10 illustrates an internal view of the vest in FIG. 9.

Access to the inflation mechanisms, discussed in more detail below, may be provided through openings 44, 46 in the inflatable bladder 20, and/or through the shell or lining 30. An oral inflation tube 22 may extend through an opening in the shell or lining. A ripcord 26 to activate a pressurized source of gas also may pass through an opening in the shell or lining. The exact placement of the inflation mechanism with respect to the shell or lining 30 and the inflatable bladder 20 may be varied and is not seen to be critical to the invention. An alternative embodiment of openings 44, 46 on garment 500 is shown in FIGS. 9 and 10.

As indicated above, the support system 80 helps hold the PFD in place. In one embodiment, the support system includes straps that are fastened to the back panel 60 of the shell or lining, or to the bladder itself, at a left portion 32, and a right portion 34, and at a collar portion 36, however, it is appreciated that these harness straps could be fastened to other portions of the PFD and the same or a different number of attachment points may be utilized. The harness straps may be permanently or removeably fixed to the shell or lining, or bladder. Regardless of the form of attachment, the connection of the support system 80 may be arranged for durability adequate to withstand forces resulting from wind, water, and general wear. Furthermore, in one embodiment the support system may be arranged to hold the wearer at approximately a 45° angle relative to the waterline. The support system is not limited to a strap type harness arrangement and other embodiments are contemplated as should be apparent to one of skill in the art including, but not limited to, flexible and adjustable fabric coverings, webbings, and other harness type arrangements which may have applications in waterskiing, parachuting and hang gliding.

Figure 11:
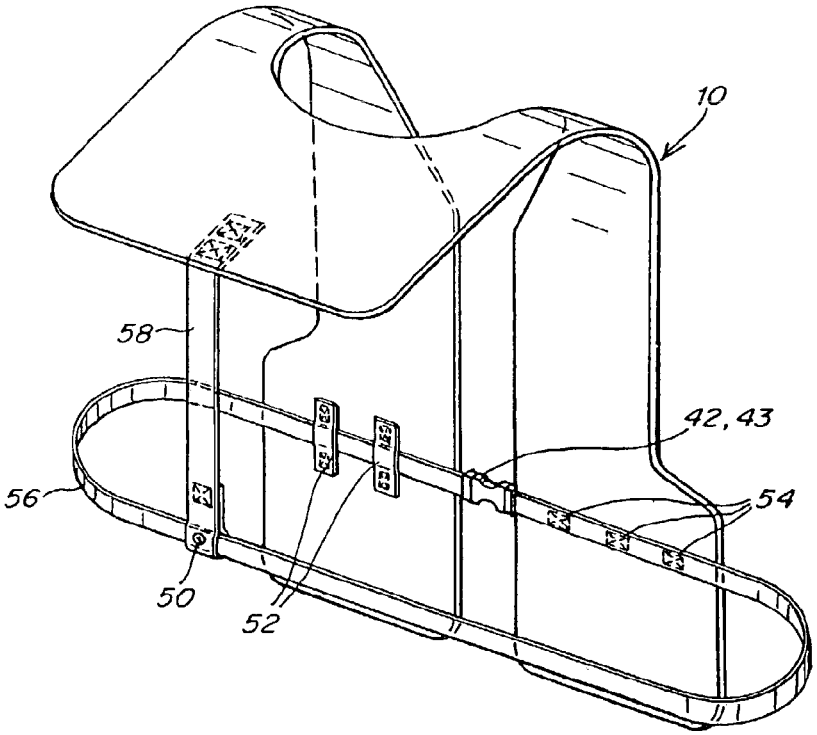
FIG. 11 illustrates an embodiment where the support system is adjustable.

In an embodiment shown in FIG. 11 the support system 80 provides adjustability to the PFD. Although the PFD may be secured to the garment through a portion of the support system, for safety reasons it may be important to be able to shift part of the support system relative to the wearer. The embodiment of FIG. 11 includes a waist strap 56 and a stability strap 58 as described above. The stability strap is secured to the waist strap through loop 50, which allows the stability strap to slide along the waist strap. Further, the PFD includes one or more loops 52 to allow a portion of the waist strap 56 to move with respect to the PFD. A portion of the waist strap may be fixed to the PFD as shown at 54. This embodiment may be implemented so that part of the support system can move relative to the wearer and part of the support system is secured to the garment.

Figure 5:
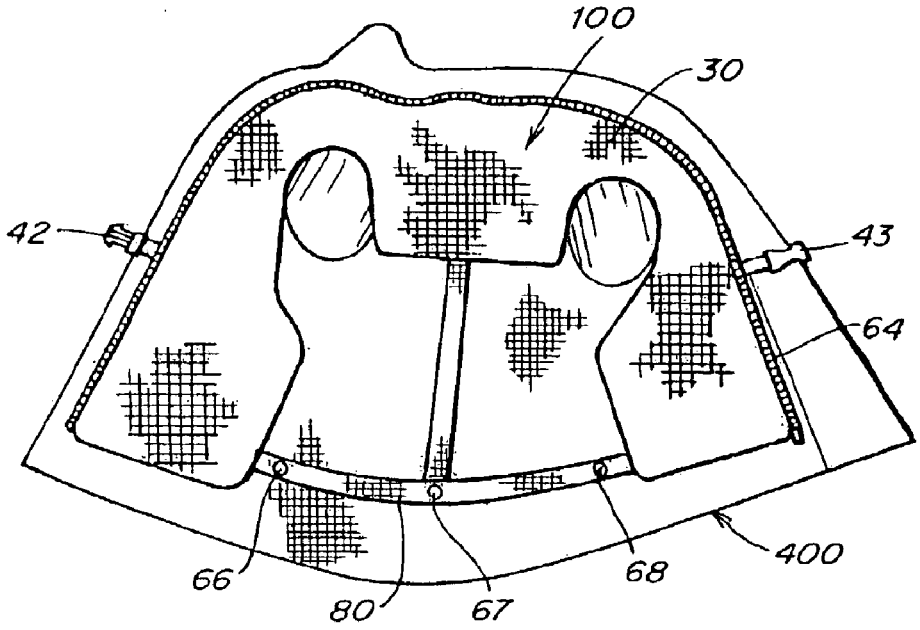
FIG. 5 illustrates the interior view of the personal flotation device liner within a jacket.
Figure 6:
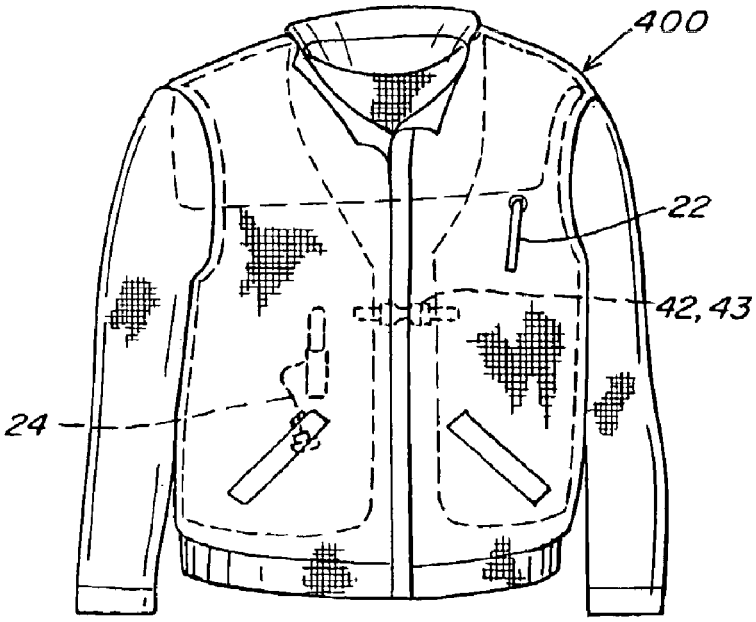
FIG. 6 illustrates a partial transparent exterior view of the personal flotation device liner within a jacket.
Figure 7:
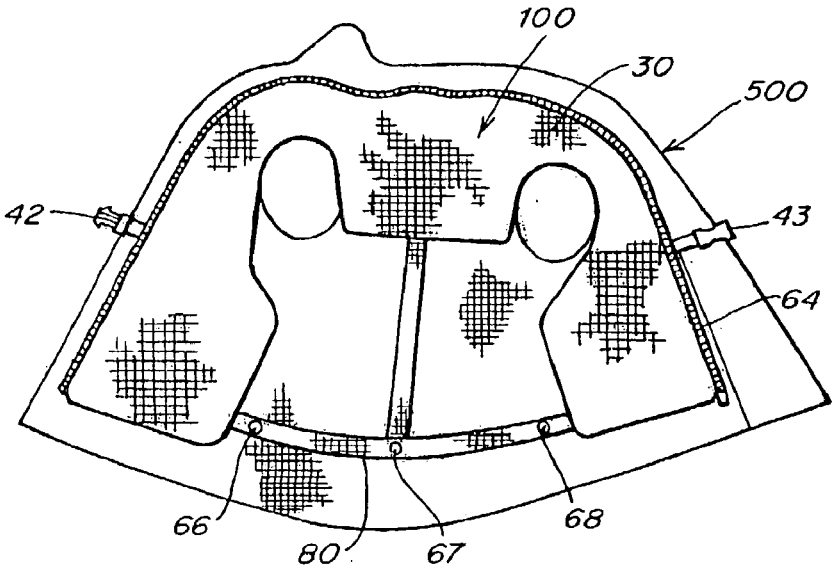
FIG. 7 illustrates the interior view of the personal flotation device liner within a vest.
Figure 8:
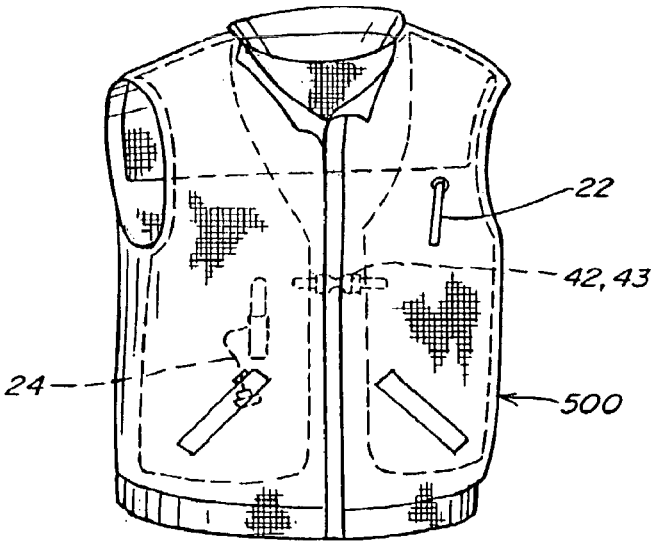
FIG. 8 illustrates a partial transparent exterior view of the personal flotation device liner within a vest.

FIGS. 5 and 6 illustrate a PFD including a bladder and a lining that is assembled into a jacket 400, while FIGS. 7 and 8 illustrate a PFD including a bladder and a lining assembled into a vest 500.

In a representative embodiment, the lining may be made of a mesh material and the bladder may be formed of heat welded urethane. The closure system may include plastic side release buckles, and the straps used in the closure system and in the attachment system may be formed of a nylon material. The separate garment, such as a jacket or vest, may be comprised of a lightweight breathable waterproof material, and may further include insulating layers. The PFD may include materials and be constructed so as to comply with current U.S. Coast Guard rules and regulations. Alternatively, the PFD may be formed of materials and/or constructed in a manner that does not meet U.S. Coast Guard approval.

The PFD may include one or more manual inflation devices, one or more automatic inflation devices, or a hybrid of both manual and automatic inflation devices. A manual oral inflation tube 22 may be provided, as may be a compressed gas cartridge 24 containing carbon dioxide, air, nitrogen, oxygen or the like that is arranged to release the pressurized gas into the bladder 20 once the cartridge 24 is manually pierced or triggered such as by a pulling a ripcord 26. The cartridge may include an automated form of inflation that includes a water-soluble capsule or dissolving disk (not shown). The dissolving disk will disintegrate upon submersion into water, triggering puncture of the cartridge 24 and leading to the release of the pressurized gas into the bladder 20. The automated form of inflation may be desirable if the wearer becomes incapable of initiating inflation of the bladder 20. The garment 200 may have openings 244 and 246 to enable inflation means such as a ripcord 26 or an inflation tube 22, that extend from the inflatable bladder, or the mesh or lining, to be easily accessible by the wearer.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A personal flotation devices comprising a wearable inflatable bladder that is selectively adjustable into a retaining configuration that closely fits to a wearer and into a loosened configuration that is removable from the wearer, said inflatable bladder arranged to keep a person buoyant in water when said bladder is inflated and in said retaining configuration;

a closure system for releasably securing said inflatable bladder to the wearer in said retaining configuration;

a first component of a releasable attachment system being provided with said wearable inflatable bladder, whereby said first component is attachable to a complementary second component of the releasable attachment system that is provided with a separate garment to integrate said inflatable bladder and the separate garment, at least a portion of said first component of the attachment system being independent of said closure system, and wherein disengagement of said closure system does not detach said first component from the complementary second component when said bladder is integrated with the garment, and wherein said bladder, when inflated, keeps a person wearing the garment integrated with said bladder, buoyant in water;

wherein said wearable inflatable bladder is separable and reunitable with the separate garment such that said wearable inflatable bladder is selectively adjustable into the retaining configuration that closely fits to the wearer when said bladder is detached from the separate garment; and a system for supporting said inflatable bladder relative to the wearer, wherein said support system includes at least one strap that surrounds a portion of the back of the wearer, and wherein said at least one strap is external of said wearable inflatable bladder.

2. The personal flotation device of claim 1, wherein said wearable inflatable bladder includes an outer shell or lining.

3. The personal flotation devise of claim 2, wherein at least one of said closure system and said first component of an attachment system is provided on said outer shell or lining.

4. The personal flotation device of claim 2, wherein said first component of a releasable attachment system is located along an inside edge of said shell or lining.

5. The personal flotation device of claim 4, wherein said first component of a releasable attachment system is located along a collar portion of said inside edge.

6. The personal flotation device of claim 2, wherein said wearable inflatable bladder is removable from said outer shell or lining.

7. The personal flotation device of claim 1, wherein said first component of a releasable attachment system includes at least one of a zipper, snap, clip, hook and loop, button, buckle, and reusable adhesive.

8. The personal flotation device of claim 1, wherein said first component of a releasable attachment system is located along an inside edge of said inflatable bladder.

9. The personal flotation device of claim 8, wherein said first component of a releasable attachment system is located along a collar portion of said inside edge.

10. The personal flotation device of claim 1, wherein said first component of a releasable attachment system is located at a bottom portion of the personal flotation device.

11. The personal flotation device of claim 1, further comprising a device for inflating said bladder.

12. The personal flotation device of claim 1 in combination with a garment, wherein said garment includes a complementary second component of the releasable attachment system.

13. The personal flotation device of claim 1, wherein said first component of a releasable attachment system is incapable of fastening a first portion of the personal flotation device to a second portion of the flotation device.

14. A personal flotation device, comprising;

a wearable inflatable bladder having first and second portions, a collar, a front side and a back side, the relative positioning of said first and second portions being selectively adjustable to vary a tightness of a fit of said wearable inflatable bladder, said inflatable bladder arranged to keep a person buoyant in water when said bladder is inflated;

a closure system for releasably securing said first and second portions at a desired tightness of fit of said inflatable bladder to the wearer;

a harness extending around said back side of said inflatable bladder; and a first component of a releasable attachment system that is attachable to a complementary component of the attachment system being provided with a separate garment to integrate said inflatable bladder and the separate garment, so that said bladder, when inflated, keeps a person wearing the garment that has been integrated with said bladder, buoyant in water, and wherein said first component of an attachment system is included on said harness.

15. The personal flotation device of claim 14, wherein said wearable inflatable bladder includes an outer shell or lining.

16. The personal flotation device of claim 15, wherein at least one of said closure system and said first component of an attachment system is provided on said outer shell or lining.

17. The personal flotation device of claim 14, wherein said harness includes at least one strap that surrounds a portion of the back of the wearer.

18. The personal flotation device of claim 17, wherein said harness includes at least one stability strap that runs from the strap that surrounds a portion of the back of the wearer to an upper end of the personal flotation device.

19. The personal flotation device of claim 18, wherein said stability strap is constructed and arranged so that a portion of the harness can move relative to the wearer.

20. The personal flotation device of claim 14, wherein said first component of a releasable attachment system includes at least one of a zipper, snap, clip, hook and loop, button, buckle, and reusable adhesive.

21. The personal flotation device of claim 14, wherein said first component of a releasable attachment system is located along an inside edge of said inflatable bladder.

22. The personal flotation device of claim 21, wherein said first component of a releasable attachment system is located along a collar portion of said inside edge.

23. The personal flotation device of claim 14, wherein said first component of a releasable attachment system is located along an inside edge of said shell or lining.

24. The personal flotation device of claim 23, wherein said first component of a releasable attachment system is located along a collar portion of said inside edge.

25. The personal flotation device of claim 14, wherein said first component of a releasable attachment system is located at a bottom portion of the personal flotation device.

26. The personal flotation device of claim 14, further comprising a device for inflating said bladder.

27. The personal flotation device of claim 14, in combination with a garment, wherein the garment includes a complementary second component of the releasable attachment system.

28. The personal flotation device of claim 14, wherein said first component of a releasable attachment system is incapable of fastening said first portion of the personal flotation device to said second portion of the flotation device.

29. A personal flotation device, comprising:

a wearable inflatable bladder having first and second chest portions, a collar, and an inner edge that extends along said first and second chest portions and said collar, the relative positioning of said first and second chest portions being selectively adjustable to vary a tightness of a fit of said wearable inflatable bladder, said inflatable bladder arranged to keep a person buoyant in water when said bladder is inflated;

a closure system for releasably securing said first and second chest portions at a desired tightness of fit;

a first component of a releasable attachment system provided with said wearable inflatable bladder, whereby said first component is distinct from the closure system and attachable to a complementary component of the attachment system being provided with a separate garment to integrate said inflatable bladder and the separate garment, so that said bladder, when inflated, keeps a person wearing the garment that has been integrated with said bladder buoyant in water, and wherein said first component of an attachment system is arranged adjacent at least a portion of said inner edge;

wherein said wearable inflatable bladder is separable and reunitable with the separate garment such that said wearable inflatable bladder is selectively adjustable to vary a tightness of fit about a person when said bladder is detached from the separate garment; and a system for supporting said inflatable bladder relative to the wearer, wherein said support system includes a harness which surround the back of the wearer, and wherein said harness is external of said wearable inflatable bladder.

30. The personal flotation device of claim 29, wherein said wearable inflatable bladder includes an outer shell or lining.

31. The personal flotation device of claim 30, wherein at least one of said closure system and said first component of an attachment system is provided on said outer shell or lining.

32. The personal flotation device of claim 30, wherein said wearable inflatable bladder is removable from said outer shell or lining.

33. The personal flotation device of claim 29, wherein said harness includes at least one strap that surrounds a portion of the back of the wearer.

34. The personal flotation device of claim 29, wherein said first component of a releasable attachment system includes at least one of a zipper, snap, clip, hook and loop, button, buckle, and reusable adhesive.

35. The personal flotation device of claim 29, further comprising a device for inflating said bladder.

36. The personal flotation device of claim 29 in combination with a garment, wherein said garment includes a complementary second component of the releasable attachment system.

37. The personal flotation device of claim 29, wherein said first component of a releasable attachment system is incapable of fastening said first chest portion of the personal flotation device to said second chest portion of the flotation device.

38. A personal flotation device, comprising:

a fabric shell or lining including an inflatable bladder, said fabric shell or lining having a first section and a second section, a relative positioning of said first section and said second section being selectively adjustable into a retaining configuration where the fabric shell or lining is fitted to the wearer and into a loosened configuration where the fabric shell or lining is removable from the wearer;

a closure system for releasably securing said first and second sections in said retaining configuration so that said bladder, when inflated, keeps a person buoyant in water when wearing said fabric shell or lining alone;

a first component of a releasable attachment system that is arranged with said fabric shell or lining and that as releasably engaged with a complementary component of said releasable attachment system that is associated with a separate garment, at least a portion of said first component of the attachment system being independent of said closure system, and integrating said fabric shell or lining with said separate garment so that said bladder, when inflated, keeps a person wearing the garment integrated with said fabric shell or lining and in said retaining configuration, buoyant in water, wherein said fabric shell or lining with inflatable bladder is separable and reunitable with the separate garment such that said fabric shell or lining with inflatable bladder is selectively adjustable into a retaining configuration that is fitted to the wearer when said fabric shell or lining with bladder is detached from the separate garment; and a system for supporting said inflatable bladder relative to the wearer, wherein said support system includes at least one strap that surrounds a portion of the back of the wearer, and wherein said at least one strap is external of said wearable inflatable bladder.

39. The personal flotation device of claim 38, wherein said closure system includes at least one of a zipper, snap, clip, book and loop, button, buckle, and reusable adhesive.

40. The personal flotation device of claim 38, wherein said first component of the releasable attachment system is located along an inside edge of said shell or lining.

41. The personal flotation device of claim 40, wherein said first component of the releasable attachment system is located along a collar portion of said inside edge.

42. The personal flotation device of claim 38, wherein said first component of the releasable attachment system is located at a bottom portion of the personal flotation device.

43. The personal flotation device of claim 38, further comprising a device for inflating said bladder.

44. The personal flotation device of claim 38, inn combination with a garment, wherein said garment includes a complementary component of the releasable attachment system.

45. The personal flotation divice of claim 38, wherein said inflerable bladder is removable from said fabric shell or lining.

46. A personal flotation device, comprising:

a wearable inflatable bladder;

means for releasably fitting said inflatable bladder to a person so that the person becomes buoyant in water when the bladder, worn alone, is inflated;

means for releasably attaching said inflatable bladder to a complementary component that is associated with a separate garment so that said inflatable bladder is integrated with the separate garment, wherein at least a portion of said means for releasably fitting being independent of said means for releasably attaching, wherein said inflatable bladder stays attached to the separate garment when said releasable fitting means is released, and wherein a person wearing the separate garment integrated with said inflatable bladder is buoyant in water when said bladder is inflated;

wherein said wearable inflatable bladder is separable and reunitable with the separate garment such that said wearable inflatable bladder may be worn alone when said bladder is detached from the separate garment; and a system for supporting said inflatable bladder relative to the wearer, wherein said support system includes at least one strap that surround, a portion of the back of the wearer, and wherein said at least one strap is external of said wearable inflatable bladder.

47. The personal flotation device of claim 46, further comprising means for inflating the bladder.

48. The personal flotation device of claim 46, wherein said wearable inflatable bladder includes an outer shell or lining.

49. The personal flotation device of claim 48, wherein at least one of said means for releasably fitting or means of releasably attaching is provided on said outer shell or lining.

50. The personal flotation device of claim 48, wherein said wearable inflatable bladder is removable from said outer shell or lining.

51. A method of assembling a personal flotation device, comprising:

providing a wearable inflatable bladder having a closure system that is selectively adjustable to vary a tightness of said inflatable bladder about a wearer, and a first component of a releasable attachment system, wherein said first component is distinct from said closure system;

providing a system for supporting said inflatable bladder relative to the wearer, wherein said support system includes at least one strap that surrounds a portion of the back of the wearer, wherein said at least one strap is external of said wearable inflatable bladder;

providing a separate garment;

attaching said wearable inflatable bladder to an innermost surface of the separate garment with said first component of the releasable attachment system so that the garment is integrated with said inflatable bladder, whereby a person wearing the garment integrated with said bladder will be buoyant inn water when the bladder is inflated; and removing said wearable inflatable bladder from said separate garment, whereby a person wearing said wearable inflatable bladder with said support system will be buoyant in water when the bladder is inflated.

52. The method of claim 51, wherein said wearable inflatable bladder further includes a first section, a second section, and a collar, and wherein said separate garment further includes a collar and a first and second portion.

53. A personal flotation device comprising:

an inflatable bladder removably received within a first garment, said first garment having a first arm opening, a second arm opening, and a collar defining a neck opening, a closure system included with said first garment for securing said fist garment about a wearer, said inflatable bladder arranged within said first garment to keep a wearer buoyant in water when said inflatable bladder is inflated and received within said first garment, and said first garment is secured about a wearer; and a first component of a releasable attachment system included with said first garment for attaching said first garment to a second garment to position said first garment adjacent the inner surface of the second garment while said inflatable bladder is removably received within said first garment, wherein said first component of the releasable attachment system is attachable to a complementary system that is provided with the second garment, and wherein at least a portion of said closure system is independent of said first component of the releasable attachment system, said closure system securing said first garment about a wearer when said first garment is attached to the second garment.

54. The personal flotation device of claim 53, in combination with the second garment, wherein said second garment includes a complementary system attachable to the first component of the releasable attachment system.

55. The personal flotation device of claim 54, further comprising a second closure system on said second garment for securing the second garment about a wearer.

56. The personal flotation device of claim 53, wherein at least a portion of the closure system is adapted to be positioned behind at least a portion of said inflatable bladder when said inflatable bladder and said first garment are secured about a wearer.

57. A personal flotation device, comprising:

a wearable inflatable bladder having first and second chest portions, said inflatable bladder being selectively adjustable into a retaining configuration that closely fits to a wearer and into a loosened configuration that is removable from the wearer, said inflatable bladder arranged to keep a person buoyant inn water when said bladder is inflated and in said retaining configuration;

a closure system for releasably securing said inflatable bladder to the wearer in said retaining configuration, wherein at least a portion of said closure system is adapted to be positioned behind at least one of said first and second chest portions of said inflatable bladder when said inflatable bladder is in said retaining configuration; and a first component of a releasable attachment system being provided with said wearable inflatable bladder, whereby said first component is attachable to a complementary second component of the releasable attachment system that is provided on a separate garment to integrate said inflatable bladder and the separate garment, at least a portion of said first component of the attachment system being independent of said closure system, and wherein said bladder, when inflated, keeps a person wearing the garment integrated with said bladder, buoyant in water;

wherein said wearable inflatable bladder is separable and reunitable with the separate garment such that said wearable inflatable bladder is selectively adjustable into the retaining configuration that closely fits to the wearer when said bladder is detached from the separate garment; and a system for supporting said inflatable bladder relative to the wearer, wherein said support system is external of said wearable inflatable bladder.

58. The personal flotation device of claim 57, in combination with a garment, wherein said garment includes a complementary second component of the releasable attachment system.

59. A personal flotation device, comprising:

a wearable inflatable bladder having first and second chest portions and a collar defining a head support, said inflatable bladder being selectively adjustable into a retaining configuration that closely fits to a wearer and into a loosened configuration that is removable from the wearer, said inflatable bladder arranged to keep a person buoyant inn water when said bladder is inflated and in said retaining configuration;

a closure system for releasably securing said inflatable bladder to the wearer in said retaining configuration;

a first component of a releasable attachment system being provided with said wearable inflatable bladder, whereby said first component is attachable to a complementary second component of the releasable attachment system that is provided on a separate garment to integrate said inflatable bladder and the separate garment, at least a portion of said first component of the attachment system being independent of said closure system, and wherein said bladder, when inflated, keeps a person wearing the garment integrated with said bladder, buoyant in water;

wherein said wearable inflatable bladder is separable and reunitable with the separate garment such that said wearable inflatable bladder is selectively adjustable into the retaining configuration that closely fits to the wearer when said bladder is detached from the separate garment; and a system for supporting said inflatable bladder relative to the wearer, wherein said support system includes at least one strap that surrounds a portion of the back of the wearer, and at least one stability strap that extend from said head support to said strap that surrounds a portion of the back of the wearer.

60. The personal flotation device of claim 59, in combination with a garment, wherein said garment includes a complementary second component of the releasable attachment system.

* * * * *